US006673233B1

(12) United States Patent
Mizuno et al.

(10) Patent No.: US 6,673,233 B1
(45) Date of Patent: Jan. 6, 2004

(54) METHOD OF ISOMERIZING LIGHT HYDROCARBON OIL

(75) Inventors: Kunihiko Mizuno, Saitama (JP); Takao Kimura, Saitama (JP); Takahiro Kawamura, Saitama (JP); Masahiko Douta, Saitama (JP); Nobuyasu Ohshio, Saitama (JP)

(73) Assignees: Cosmo Research Institute, Tokyo (JP); Cosmo Oil Co., Ltd., Tokyo (JP)

( * ) Notice: Subject to any disclaimer, the term of this patent is extended or adjusted under 35 U.S.C. 154(b) by 0 days.

(21) Appl. No.: 09/582,436

(22) PCT Filed: Dec. 24, 1998

(86) PCT No.: PCT/JP98/05874

§ 371 (c)(1),
(2), (4) Date: Jun. 26, 2000

(87) PCT Pub. No.: WO99/33937

PCT Pub. Date: Jul. 8, 1999

(30) Foreign Application Priority Data

Dec. 25, 1997 (JP) ..... 9-357561

(51) Int. Cl.[7] ..... C10G 45/00; C10G 64/02; C10G 35/04

(52) U.S. Cl. ..... 208/57; 585/60; 585/84; 585/134; 585/204; 585/212

(58) Field of Search ..... 208/57, 60, 84, 208/134, 204, 212

(56) References Cited

U.S. PATENT DOCUMENTS 5,036,035 A 7/1991 Baba et al.
5,183,556 A 2/1993 Reilly et al.
5,362,376 A * 11/1994 Shih et al. ..... 208/89
5,516,964 A 5/1996 Umansky et al.
5,837,641 A 11/1998 Gosling et al.

FOREIGN PATENT DOCUMENTS

| | | |
|---|---|---|
| JP | 8-502533 | 3/1996 |
| JP | 9-253488 | 9/1997 |
| JP | 9-290160 | 11/1997 |
| WO | WO 94/09090 | 4/1994 |
| WO | WO 95/03121 | 2/1995 |

OTHER PUBLICATIONS

International Search Report.
Database WPI Section Ch, Week 198701 Derwent Publications Ltd., London, GB; Class E19, AN 1987–003725 XP002194574 & JP 61 263932 (Abstract).
Database WPI Section Ch, Week 199435 Derwent Publications Ltd., London, GB; Class E17, AN 1994–282686 XP002194573 & JP 61 263932 (Abstract).
Communication.

* cited by examiner

*Primary Examiner*—Thuan D. Dang
(74) *Attorney, Agent, or Firm*—Sughrue Mion, PLLC

(57) ABSTRACT

A process for isomerizing a light hydrocarbon oil which comprises: subjecting the light hydrocarbon oil to a hydrogenation treatment for converting an organosulfur component in the light hydrocarbon oil into hydrogen sulfide to give an organosulfur content of from 0 to 30 mass ppm as a pretreatment step; and isomerizing the light hydrocarbon oil still containing the converted hydrogen sulfide in the presence of a solid super strong acid catalyst under conditions at a temperature of from 190 to 300° C., a pressure of from 1 to 50 kg/cm$^2$g, an $H_2$/oil ratio of from 180 to 1800 liter/liter, and an LHSV of from 2 to 10 hr$^{-1}$ as an isomerization step.

14 Claims, 5 Drawing Sheets

METHOD OF ISOMERIZING LIGHT HYDROCARBON OIL

TECHNICAL FIELD

The present invention relates to a process for isomerizing a light hydrocarbon oil. More particularly, the present invention relates to a process for isomerizing a light hydrocarbon oil with a simpler equipment and more economically than in conventional processes.

BACKGROUND ART

Isomerization of light hydrocarbon oils is an important technique in organic synthesis chemistry which has conventionally been used frequently in the petroleum refining industry and petrochemical industry. For example, the technique is used for isomerizing n-paraffin which has a straight chain and is liquid at ordinary temperature to isoparaffin, having a side chain, to thereby produce a high-octane-number blending base necessary for improving the octane number of fuel oils for motor vehicles and aircraft. The technique is further used for isomerizing a cyclic compound, such as methylcyclopentane or the like, to cyclohexane, which is effectively utilized as a feed in the organic industry.

In particular, as a result of performance advancement in automotive and aircraft engines, the gasolines for use as fuels therein are required to have a high octane number. Conventional processes for improving the octane number of a gasoline include a process of adding a lead compound octane number improver and a process of blending a large amount of a blending material having a high octane number, e.g., an aromatic hydrocarbon.

However, the addition of a leadoctane number improver has been prohibited because it causes the problem of air pollution, while use of a gasoline having a high aromatic hydrocarbon concentration results in a high aromatic hydrocarbon concentration in the exhaust gas discharged into the air.

Improving octane number by isomerization is hence becoming important more and more. Incidentally, improving octane number by isomerization is not easy technically. For example, it has technically been extremely difficult to improve a gasoline base having an octane number of 80 so that its octane number is elevated by only 1 to 81.

Accordingly, many investigations have conventionally been made on processes for isomerizing a light hydrocarbon oil, and various catalysts for use in the reaction are disclosed. The most useful isomerization catalysts among these include solid super strong acid catalysts.

The solid super strong acid catalysts including those composed of $Pt/ZrO_2/SO_4$ have various advantages. For example, these catalysts have a high isomerization activity at a reaction temperature of 400° C. or less and can be easily prepared and handled. Furthermore, since they are relatively highly durable in the presence of water and the like, pretreatments, such as dehydration and the like, can be omitted in isomerizing light hydrocarbon oils.

However, there has been a problem that when a light hydrocarbon oil which has not undergone the so-called hydrogenation treatment wherein desulfurization is conducted by hydrogenation and which contains a sulfur compound at a high concentration is passed through a layer of a solid super strong acid catalyst, then the solid super strong acid catalyst is poisoned by sulfur and is deprived of its catalytic activity in a relatively short time period.

Therefore, it is difficult for a light hydrocarbon oil containing sulfur at a high concentration to be directly isomerized without being hydrogenated.

A conventional process for isomerizing a light hydrocarbon oil is hence conducted in the manner shown in FIG. 5. First, a light hydrocarbon oil as a feed oil is subjected to a hydrogenation treatment. In the hydrogenation treatment, pressurized hydrogen gas is mixed with the pressurized light hydrocarbon oil and the mixture is heated to a reaction temperature with a heating furnace 32. The light hydrocarbon oil is passed through a hydrogenation reaction column 34 having a hydrogenation reaction catalyst layer disposed therein. Thus, the light hydrocarbon oil is hydrogenated to convert sulfur compounds contained in the light hydrocarbon oil into hydrogen sulfide.

Subsequently, the light hydrocarbon oil containing hydrogen sulfide formed in the hydrogenation reaction column 34 is cooled with a heat exchanger or cooler 36 and sent to a gas/liquid separation vessel 38, where the light hydrocarbon oil is separated from the hydrogen sulfide. The hydrogen sulfide is removed. During the hydrogen sulfide removal, most of the hydrogen gas is also separated from the light hydrocarbon oil.

The light hydrocarbon oil which has come out of the gas/liquid separation vessel 38 is then distilled in a distillation column 40 to separate light gas components. The light hydrocarbon oil coming out of the bottom of the distillation column 40 is used as a feed oil for an isomerization step.

Furthermore, the light hydrocarbon oil obtained through the bottom of the distillation column 40 is pressurized and hydrogen gas is forced thereinto. This mixture fluid is heated to a reaction temperature with the heating furnace 42. The light hydrocarbon oil as a feed oil is passed through an isomerization column 44 having a layer of a solid super strong acid catalyst disposed therein to isomerize the light hydrocarbon oil.

Conditions for the conventional isomerization step include a pressure of 30 $kg/cm^2g$, an $H_2$/oil ratio of 370 liter/liter, and a reaction temperature of 185° C. or more.

However, the conventional process for isomerizing a light hydrocarbon oil is complicated because not only the step of conversion to hydrogen sulfide through hydrogenation treatment but also the step of separating and removing the hydrogen sulfide and the step in which the light hydrocarbon oil which has been separated from the hydrogen sulfide is distilled to prepare a feed oil are conducted as pretreatments for the isomerization treatment of the light hydrocarbon oil. Consequently, the conventional process has had the following problems.

1) A large-scale equipment including, e.g., a gas/liquid separation vessel and a distillation column is necessary for conducting the step of separating and removing hydrogen sulfide and the step of preparing a feed oil. Furthermore, operation of the equipment necessitates personnel and utilities, such as steam, cooling water, and the like. As a result, the equipment cost and operating cost are high and, hence, the cost of isomerizing a light hydrocarbon oil is increased.
2) Due to the step of separating and removing hydrogen sulfide is conducted, it is necessary to temporarily cool the light hydrocarbon oil which has come out of the hydrogenation reaction column and contains hydrogen sulfide. As a result, the step of isomerizing the light hydrocarbon oil necessitates heating the feed oil to a given isomerization temperature and thereby consumes a large amount of thermal energy.

3) Still another problem is that since the separation and removal of hydrogen sulfide is accompanied with separation of hydrogen gas, it is necessary to freshly force hydrogen gas into the light hydrocarbon oil in the isomerization step, resulting in an increase in the cost of hydrogen gas.

DISCLOSURE OF THE INVENTION

An object of the present invention is to provide a process for isomerizing a light hydrocarbon oil with a simpler equipment and more economically than in conventional processes.

As a result of various experiments, the present inventors have found that hydrogen sulfide does not act as a catalyst poison on solid super strong acid catalysts when isomerization is conducted at a temperature higher by at least about 5 to 20° C. than the conventional isomerization temperatures, although the temperature cannot be unconditionally specified because it depends on the catalysts. The process of the present invention has thus been completed.

The present invention relates to a process for isomerizing a light hydrocarbon oil which comprises:

subjecting the light hydrocarbon oil to a hydrogenation treatment for converting an organosulfur component in the light hydrocarbon oil into hydrogen sulfide to give an organosulfur content of from 0 to 30 mass ppm as a pretreatment step; and isomerizing the light hydrocarbon oil still containing the converted hydrogen sulfide in the presence of a solid super strong acid catalyst under conditions at a temperature of from 190 to 300° C., a pressure of from 1 to 50 kg/cm$^2$g, an $H_2$/oil ratio of from 180 to 1800 liter/liter, and an LHSV of from 2 to 10 hr$^{-1}$ as an isomerization step.

BEST MODE FOR CARRYING OUT THE INVENTION

Figure 1:
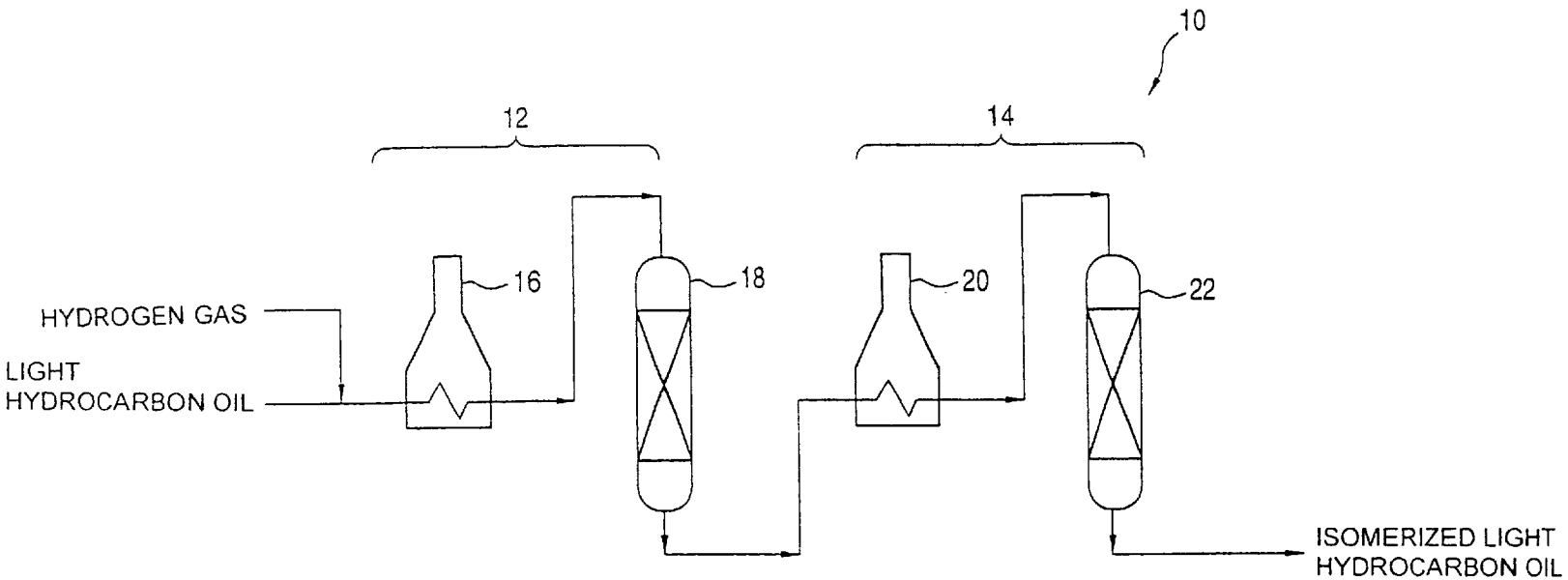
FIG. 1 is a diagrammatic flow sheet illustrating the constitution of an isomerization apparatus for use in practicing an embodiment of the process of the present invention.

In the process of the present invention, the term "still containing the converted hydrogen sulfide" means that the hydrogen sulfide formed by converting organosulfur contained in a light hydrocarbon oil through a hydrogenation treatment has not been separated from the light hydrocarbon oil and accompanies the light hydrocarbon oil to be subjected to the isomerization step.

Because the light hydrocarbon oil still containing the converted hydrogen sulfide can be isomerized, the process of the present invention has the following advantages:

(1) the process does not necessitate such an uneconomical procedure as in conventional processes that a light hydrocarbon oil which has been subjected to a hydrogenation treatment is temporarily cooled for hydrogen sulfide separation and then reheated for isomerization;

(2) due to that separation of hydrogen sulfide is unnecessary, the process of the present invention is free from the need of freshly forcing hydrogen gas into the light hydrocarbon oil prior to isomerization, unlike conventional processes in which the separation of hydrogen sulfide from a light hydrocarbon oil is accompanied with consumption of hydrogen gas; and (3) due to that the high-pressure light hydrocarbon oil which has been subjected to a hydrogenation treatment can be sent as it is to an isomerization step, the process does not necessitate such an uneconomical procedure as in conventional processes that the light hydrocarbon oil is temporarily depressurized for hydrogen sulfide separation and then pressurized again in sending the hydrocarbon oil to an isomerization step.

Due to these advantages, the costs of hydrogen gas, thermal energy, and power are considerably reduced.

In the process of the present invention, when the pressure and the $H_2$/oil ratio in the pretreatment step are regulated to from 1 to 50 kg/cm$^2$g and from 180 to 1800 liter/liter, respectively, in particular, when the pressure and the $H_2$/oil ratio in the pretreatment step are regulated respectively to the same values as in the isomerization step, then there is no need of forcing hydrogen gas into the light hydrocarbon oil or pressurizing the light hydrocarbon oil in sending the light hydrocarbon oil from the pretreatment step to the isomerization step. Namely, temperature control only is necessary and the wasteful cost of thermal energy and that of power are reduced.

Feed Oil

The feed oil to be isomerized by the process of the present invention is a light hydrocarbon oil, which is preferably a light naphtha obtained as a distillate from a crude oil with an atmospheric distillation apparatus, a light naphtha separated from a whole naphtha obtained likewise as a distillate from a crude oil with an atmospheric distillation apparatus, or an oil obtained by subjecting a light naphtha to Merox treatment.

A particularly preferred light hydrocarbon oil is a light naphtha having an ASTM distillation temperature of from 25 to 110° C., preferably from 25 to 100° C. The organosulfur content thereof as determined by coulometric titration is from 100 to 1,000 mass ppm, preferably from 140 to 700 mass ppm.

Hydrogenation Treatment Step

In this hydrogenation treatment step, organosulfur contained in the feed oil is hydrogenated in the presence of a hydrogenation catalyst to convert the organosulfur into hydrogen sulfide.

The hydrogenation catalyst for use in the process of the present invention is a known hydrogenation one. Specifically, it is a hydrogenation catalyst comprising an inorganic support and, deposited thereon, an active metal, such as cobalt, nickel, and molybdenum metals, and the like. Examples thereof include Co/Mo, Ni/Mo, and Ni/Co/Mo hydrogenation catalysts.

The conditions for the hydrogenation treatment may be known hydrogenation treatment conditions so long as the sulfur content of the light hydrocarbon oil can be reduced to from 0 to 30 mass ppm. For example, the following conditions may be used.

Reaction temperature:

160–300° C., preferably 180–250° C. Reaction pressure:

1–50 kg/cm$^2$g, preferably 10–40 kg/cm$^2$g $H_2$/oil ratio:

180–1800 L/L, preferably 180–900 L/L LHSV:

2–10 hr$^{-1}$, preferably 2–6 hr$^{-1}$

The $H_2$/oil ratio is flow rate of hydrogen gas (liters (in the standard state) per unit time)/flow rate of light hydrocarbon oil (liter per unit time) and indicates the mixing proportion of hydrogen gas to the light hydrocarbon oil, while the term LHSV means flow rate by volume of light hydrocarbon oil (m$^3$/hr)/volume of catalyst packed in reaction column (m$^3$). (The same applies hereinafter.)

Organosulfur

The term "organosulfur" in the process of the present invention means a sulfur compound other than hydrogen sulfide, such as a mercaptan compound (R—SH), a sulfide compound (R—S—R), and the like. Specific examples of the mercaptan compound include propyl mercaptan ($C_3H_7$—SH), and specific examples of the sulfide compound include ethyl methyl sulfide ($CH_3$—S—$C_2H_5$).

The light hydrocarbon oil which has been subjected to the pretreatment step has an organosulfur content as determined by coulometric titration of from 0 to 30 mass ppm. As a result, the isomerization catalyst can retain its catalytic activity over almost the same durability as in conventional isomerization processes.

Isomerization Step

The light hydrocarbon oil which has been subjected to the hydrogenation treatment and contains hydrogen sulfide is introduced into an isomerization apparatus and subjected to isomerization.

Conditions for the isomerization are as follows.

Reaction temperature:

190–300° C., preferably 195–250° C.

Reaction pressure:

1–50 kg/cm$^2$g, preferably 10–40 kg/cm$^2$g $H_2$/oil ratio:

180–1800 L/L, preferably 180–900 L/L

LHSV:

2–10 hr$^{-1}$, preferably 2–6 hr$^{-1}$

When the reaction temperature is lower than 190° C., the isomerization catalyst has a shortened catalyst life. On the other hand, when the reaction temperature exceeds 300° C., decomposition of the light hydrocarbon oil proceeds to give an isomerized light hydrocarbon oil in a reduced yield. The lower limit of the reaction temperature is higher by at least from 5 to 20° C. than that of the reaction temperature in the conventional isomerization treatment of a light hydrocarbon oil. The conditions other than the reaction temperature, i.e., reaction pressure, $H_2$/oil ratio, and LHSV, are similar to in the conventional isomerization of a light hydrocarbon oil.

Isomerization Catalyst

The isomerization catalyst for use in the isomerization step in the present invention is a solid super strong acid catalyst, preferred examples of which include Pt/$SO_4$/$ZrO_2$ solid super strong acid catalysts.

The term "solid super strong acid catalyst" as used herein means a solid catalyst which has, deposited thereon, a super strong acid having higher acidic properties than 100% sulfuric acid, defined as a super strong acid, and having the property of enabling low-temperature paraffin structure isomerization, which are advantageous from the standpoint of thermodynamic equilibrium, to proceed even at room temperature, and which has a higher acid strength than 100% sulfuric acid and usually has a Hammett acidity function $H_0$ not higher than that of 100% sulfuric acid, whose $H_0$ is −11.93. Examples of the solid super strong acid catalyst include a catalyst having deposited thereon a compound having super strong acidity, such as $SbF_5$, $BF_3$ or the like, a catalyst obtained by treating an oxide, such as $ZrO_2$, $Fe_2O_3$, or the like, with sulfuric acid, a fluorinated sulfonic acid resin, and the like.

The solid super strong acid catalyst composition is a catalyst obtained by causing a support comprising a hydroxide or oxide of at least one metal selected from the Groups IV and III in the periodic table to contain at least one metal selected from the Groups VIII, VIIA, VIA, and IB in the periodic table (hereinafter referred to as "specific metal") and either a sulfate group or a precursor of a sulfate group, followed by burning for stabilization.

The specific metal or a metal compound each can be deposited on the support by an ordinary technique such as an impregnation process, an ion exchange process, or the like. Preferred examples of the specific metal include nickel, ruthenium, rhodium, palladium, platinum, iron, manganese, chromium, silver, and copper.

The content of the specific metal is preferably from 0.01 to 10 parts by mass per 100 parts by mass of the support. The reasons for this are that contents thereof less than 0.01 part by mass result in reduced catalytic activity of the metal and insufficient stability of the catalytic activity, while contents thereof more than 10 parts by mass result in a reduced acid strength and a reduced isomerization degree in the isomerization.

Also, the sulfate group which can be used include 0.01 to 10 N, preferably 0.1 to 5 N, sulfuric acid, ammonium sulfate having a molar concentration of from 0.1 to 10, and the like. Examples of the precursor of a sulfate group which can be used include a substance which generates a sulfate group through a catalyst burning treatment, such as hydrogen sulfide, sulfurous acid gas, and the like. The sulfur content of a catalyst is determined by burning a sample in an oxygen stream to thereby oxidize the sulfur contained in the sample into $SO_2$ and remove the water and dust and then detecting and determining the $SO_2$ with an infrared absorption detector, e.g., a solid-state detector. According to this analytical process, the sulfur contents of samples can be determined in the concentration range of from 0.001 to 99.99%.

The solid super strong acid catalyst is preferably a catalyst obtained by causing a support comprising a hydroxide or oxide of at least one Group IV or III metal in the periodic table selected from silicon, titanium, zirconium, tin, and aluminum to contain at least one Group VIII metal in the periodic table, as a specific metal, selected from nickel, ruthenium, rhodium, palladium, and platinum and either a sulfate group or a precursor of a sulfate group, followed by burning for stabilization.

More preferably, the support is zirconium hydroxide or zirconium oxide, and the Group VIII metal in the periodic table is platinum.

Processes for preparing the solid super strong acid catalyst for use in the process of the present invention are not particularly limited. Namely, any technique may be used for depositing the specific metal and a sulfate group. For example, a solid super strong acid catalyst can be prepared by incorporating a Group VIII metal onto a support, and subsequently treating the support with a treating agent containing a sulfate group, followed by burning for stabilization.

Platinum as an example of the specific metal can be deposited by immersing the support in an aqueous solution of chloroplatinic acid, a tetraammineplatinum complex, or the like. After the deposition, the support is treated with a treating agent containing a sulfate group or the like. In this case, 0.01 to 10 N, preferably 0.1 to 5 N, sulfuric acid, ammonium sulfate having a molar concentration of from 0.1 to 10, or the like is used as the treating agent containing a sulfate group in an amount of from 1 to 10 times the mass of the catalyst. The treating agent is not limited thereto, and the same effect can be produced with a treating agent which generates a sulfate group through a catalyst burning treatment, such as hydrogen sulfide, sulfurous acid gas, or the like.

Furthermore, after the treatment with a treating agent containing a sulfate group or the like, a burning/stabilization treatment is conducted for from 0.5 to 10 hours in an oxidizing atmosphere having a temperature of from 450 to 800° C., preferably from 500 to 700° C.

Through the treatments described above, a solid super strong acid catalyst showing strong acidity can be obtained as an isomerization catalyst.

Conducting the catalyst burning/stabilization treatment in a reducing atmosphere is not preferred due to that the sulfate group on the specific metal or on a compound of the specific metal undergo a phenomenon which seems to be a change in bonding state, reductive decomposition, or the like, resulting in reduced catalytic activity.

Before being used in the reaction, the solid super strong acid catalyst is preferably subjected to a pretreatment in order to stabilize the catalytic activity of the solid super strong acid catalyst, i.e., to reduce the deposited metal compound into the metal and activate the strong-acid sites. The pretreatment of the solid super strong acid catalyst may be conducted under ordinary pretreatment conditions. For example, the solid super strong acid catalyst is dried by holding it at a temperature of from 100 to 500° C. for from 1 to 5 hours and then subjected to a reduction treatment at a temperature of from 100 to 400° C., preferably from 200 to 300° C. The reduction treatment is preferably conducted in a hydrogen stream. Although the reduction treatment period depends on the treatment temperature, it is about from 5 to 20 hours when the treatment is conducted, for example, at a temperature of about 250° C.

Embodiments of the present invention will be explained below specifically and in detail by reference to an embodiment and attached drawings.

Embodiment

This embodiment is an example of an embodiment of the process for isomerizing a light hydrocarbon oil according to the present invention. FIG. 1 is a flow sheet illustrating an isomerization apparatus for use in doing this embodiment of the process for isomerizing a light hydrocarbon oil.

As shown in FIG. 1, the isomerization apparatus for practicing this embodiment is constituted basically of a pretreatment apparatus 12 for conducting a hydrogenation treatment step and an isomerization apparatus main body 14 which is connected to the pretreatment apparatus 12 and in which an isomerization step is conducted.

The pretreatment apparatus 12 has a heating furnace 16 in which a mixture fluid composed of a light hydrocarbon oil and hydrogen gas and pressurized to a given reaction pressure is heated to a given reaction temperature; and a hydrogenation reaction column 18 which has a hydrogenation reaction catalyst layer disposed therein and in which hydrogenation reaction is conducted to convert organosulfur into hydrogen sulfide.

The isomerization apparatus main body 14 has a heating furnace 20 in which the light hydrocarbon oil containing hydrogen sulfide which has flowed from the hydrogenation reaction column 18 is heated to a given reaction temperature; and an isomerization column 22 having an isomerization catalyst layer disposed therein. The light hydrocarbon oil containing hydrogen sulfide which has flowed from the hydrogenation reaction column 18 is directly received and isomerized by the apparatus main body 14 without separating the hydrogen sulfide from the light hydrocarbon oil.

In this embodiment of the process for isomerizing a light hydrocarbon oil, a pretreatment step is first conducted with the pretreatment apparatus 12. In the pretreatment step, hydrogen gas is forced into a light hydrocarbon oil pressurized to a pressure of from 1 to 50 kg/cm$^2$g in an amount to give an $H_2$/oil ratio of from 180 to 1800 liter/liter, and the mixture is heated with the heating furnace 16 to a temperature in the range of from 160 to 300° C. Subsequently, the heated mixture fluid composed of the light hydrocarbon oil and hydrogen gas is introduced into the hydrogenation reaction column 18 at such a flow rate for the light hydrocarbon oil as to result in an LHSV of from 2 to 10 hr$^{-1}$. In this pretreatment step, the organosulfur contained in the light hydrocarbon oil is hydrogenated and thus converted to hydrogen sulfide, whereby the content thereof decreases to between 0 mass ppm and 30 mass ppm.

Subsequently, the light hydrocarbon oil which has been subjected to the pretreatment step is subjected to an isomerization step with the main body of the isomerization apparatus 14. In the isomerization step, the light hydrocarbon oil containing hydrogen sulfide which has flowed from the hydrogenation reaction column 18 is heated to 190 to 300° C. with the heating furnace 20 and is then introduced into the isomerization column 22 and isomerized. The isomerization column 22 is packed with a solid super strong acid catalyst as an isomerization catalyst so as to give an LHSV of from 2 to 10 hr$^{-1}$.

In order to evaluate the process of the present invention, a fixed bed flow system reactor having a catalyst capacity of from 50 to 100 ml was used as a hydrogenation reaction column and an isomerization column to fabricate a test apparatus having basically the same constitution as the isomerization apparatus 10 for use in the embodiment. The test apparatus was used to conduct Examples 1 to 3 and Comparative Examples 1 to 5.

Hereinafter, the content of organosulfur was determined with sulfur content analyzer TS-03, manufactured by Mitsubishi Chemical Corporation, by the coulometric titration process. The contents of 2-methylbutane (hereinafter referred to as "i-$C_5$), n-pentane (hereinafter referred to as "n-$C_5$"), 2,2-dimethylpropane (hereinafter referred to as "22DM$C_3$"), and others were determined with a gas chromatograph/flame ionization detector (GC/FID). The sulfur content in each catalyst was determined with sulfur content analyzer SC-132, manufactured by LECO Corp.

EXAMPLE 1

In Example 1, the light hydrocarbon oil as a feed oil, hydrogenation reaction catalyst, and isomerization catalyst shown below were used to conduct hydrogenation reaction and isomerization under the following conditions.

1) Feed Oil

Feed oil name: light naphtha I

ASTM distillation characteristics:

| | |
|---|---|
| IBP | 28.0° C. |
| 10% | 35.0° C. |

-continued

| | |
|---|---|
| 50% | 47.5° C. |
| 90% | 75.5° C. |
| 95% | 83.0° C. |
| EP | 91.0° C. |

Organosulfur content: 310 mass ppm

Content of i-$C_5$: 19.66 mass %

Content of n-$C_5$: 28.08 mass %

Content of 22DMC$_3$: 0.08 mass %

Others: 52.18 mass %

Isomer proportion: 41.28%

The isomer proportion (%) is a value determined by analyzing $C_5$ components in the feed oil to determine the mass% of each of i-$C_5$, 22DMC$_3$, and n-$C_5$ and the proportion is calculated by using the following equation (the same applies hereinafter).

$$\text{Isomer proportion (\%)}=((\text{i-C}_5+22\text{DMC}_3)/(\text{i-C}_5+22\text{DMC}_3+\text{n-C}_5))\times 100$$

2) Hydrogenation Reaction Catalyst

Catalyst name: Co/Mo hydrogenation reaction catalyst (trade name, S-12H; manufactured by Nikki-Universal)

Content of CoO: 16.5% (in terms of oxide)

Content of MoO: 4.5% (in terms of oxide)

Support: $\gamma$-$Al_2O_3$

3) Isomerization Catalyst

Catalyst name: Pt/$SO_4$/$ZrO_2$ solid super strong acid catalyst

Content of Pt: 0.50 mass %

Content of $SO_4$: 4.6 mass % (content of S: 1.87 mass %)

Support: $ZrO_2$

Number of regeneration treatments: 4

Before isomerization, the solid super strong acid catalyst was subjected to a pretreatment in the following manner. In the pretreatment, the solid super strong acid catalyst was first placed in an electric furnace, in which the catalyst was subjected to a drying treatment by holding it in an air stream at 450° C. for 12 hours. Subsequently, the solid super strong acid catalyst was packed into a fixed bed flow system reactor and then subjected to a reduction treatment by holding it in an atmospheric-pressure hydrogen stream at 300° C. for 3 hours.

The solid super strong acid catalyst used was not a freshly prepared catalyst but a catalyst which had been used in isomerization, i.e., which had been repeatedly used in isomerization while undergoing a regeneration treatment four times due to a decrease in catalytic activity.

4) Hydrogenation Reaction Conditions

Reaction temperature: 230° C.

Reaction pressure: 30 kg/cm$^2$g

LHSV: 2.9

$H_2$/oil ratio: 370 liter/liter

Content of organosulfur: 3 mass ppm

5) Isomerization Conditions

Reaction temperature: 198° C.

Reaction pressure: 30 kg/cm$^2$g

LHSV: 2.9

$H_2$/oil ratio: 370 liter/liter

Experimental Results

The sample in the isomerization column was sampled during the isomerization at intervals in the time on stream, and $C_5$ components therein were analyzed to determine each vol % of i-$C_5$, 22DMC$_3$, and n-$C_5$. The isomer proportion was calculated using the equation given above.

Figure 2:
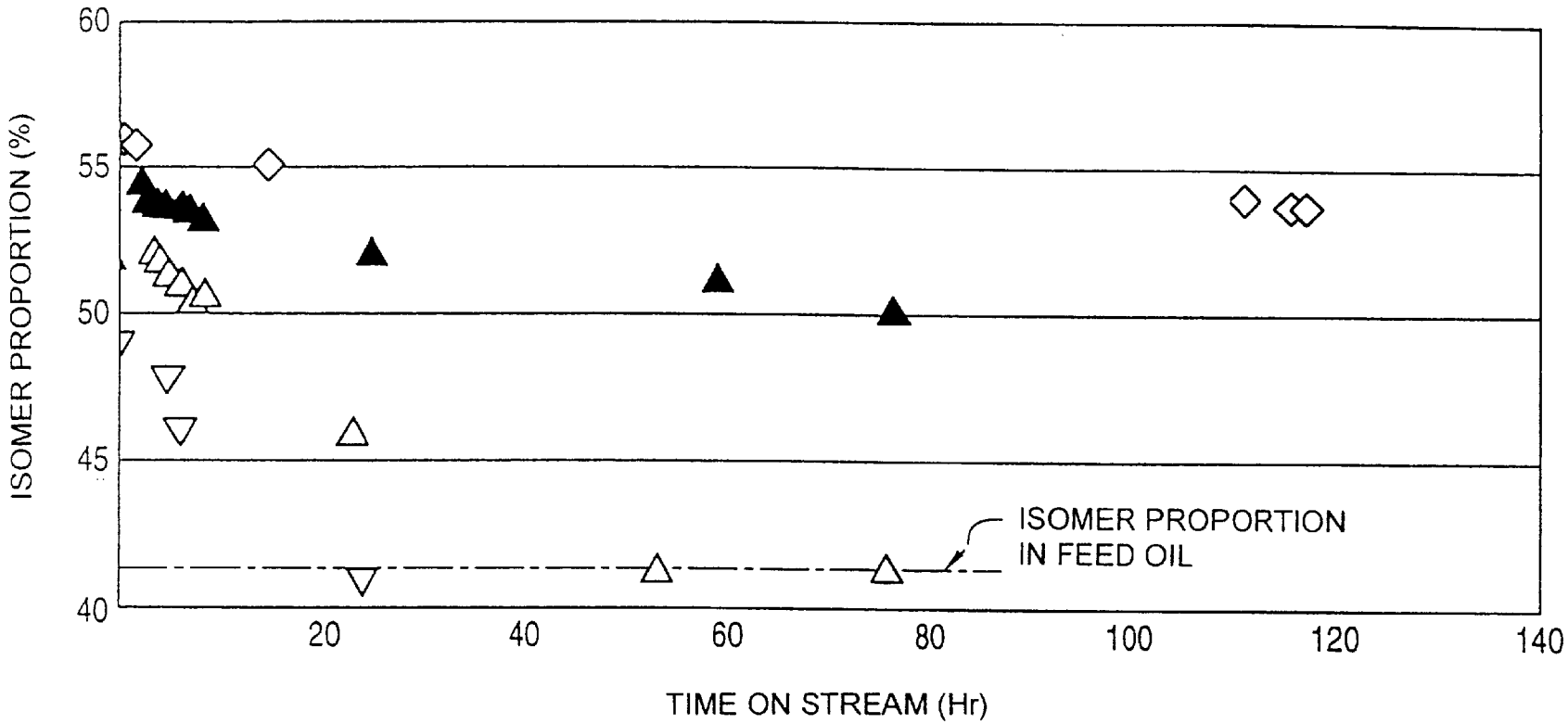
FIG. 2 is a graph showing the relationship between the isomer proportion in the isomerized light hydrocarbon oil and the time on stream in each of Examples 1 (◇) and 2 (▲) and Comparative Examples 1 (Δ) and 2 (▽).

The isomer proportions obtained are as shown in FIG. 2 and Table 2. Table 1 shows the hydrogenation reaction conditions used in Examples 1, 2, Comparative Examples 1 and 2. Table 2 shows that the isomer proportion in Example 1 was 53.94% even at the time when the time on stream was 118 hours. Consequently, the difference between that sample and the feed oil was 12.66%.

TABLE 1

| | Ex. 1 | Ex. 2 | Comp. Ex. 1 | Comp. Ex. 2 |
|---|---|---|---|---|
| Organosulfur content (mass ppm) | 3 | 20 | 40 | 100 |
| Reaction temperature (° C.) | 230 | 180 | 145 | 125 |
| Reaction pressure (kg/cm$^2$g) | 30 | ← | ← | ← |
| LHSV | 2.9 | ← | ← | ← |
| $H_2$/Oil (liter/liter) | 370 | ← | ← | ← |

TABLE 2

| | Isomer proportion in isomerized light hydrocarbon oil (%) | | | |
|---|---|---|---|---|
| Reaction time (h) | Ex. 1 | Ex. 2 | Comp. Ex. 1 | Comp. Ex. 2 |
| 0 | 56.16 | | 51.85 | 48.87 |
| 1 | 55.94 | | | |
| 2 | 55.76 | | | |
| 3 | | 54.61 | | |
| 3.5 | | 53.99 | | |
| 4 | | 53.78 | 52.03 | |
| 4.5 | | 53.75 | 51.80 | |
| 5 | | | | 47.75 |
| 5.5 | | 53.73 | 51.40 | |
| 6 | | | | 46.02 |
| 6.5 | | 53.66 | 51.13 | |
| 7 | | 53.59 | | |
| 7.5 | | | 50.60 | |
| 8.5 | | 53.30 | 50.74 | |
| 15 | 55.17 | | | |
| 23 | | | 46.08 | |
| 23.5 | | | | 40.85 |
| 25 | | 52.24 | | |
| 53 | | | 41.24 | |
| 60 | | 51.33 | | |
| 76 | | | 41.00 | |
| 77 | | 50.36 | | |
| 112 | 54.23 | | | |
| 116 | 53.91 | | | |
| 118 | 53.94 | | | |

EXAMPLE 2

In Example 2, the same experiment as in Example 1 was conducted, except that in the hydrogenation reaction treatment, the reaction temperature was set at 180° C. to give an organosulfur content of 20 mass ppm. The isomer proportion in Example 2 was determined at intervals in the time on stream in the same manner as in Example 1, and the results are shown in FIG. 2 and Table 2.

In Example 2, the isomer proportion at the time when the time on stream was 77 hours was 50.36%, and the difference between the sample and the feed oil was 9.08%.

Comparative Examples 1 and 2

In Comparative Examples 1 and 2, the same experiment as in Example 1 was conducted, except that in the hydrogenation reaction treatment, the reaction temperature was set at 145° C. and 125° C. to give organosulfur contents of 40 mass ppm and 100 mass ppm, respectively. The isomer proportions in Comparative Examples 1 and 2 were determined at intervals in the time on stream in the same manner as in Example 1, and the results are shown in FIG. 2 and Table 2.

In Comparative Example 1, the isomer proportion at the time when the time on stream was 76 hours was 41.00%. In Comparative Example 2, the isomer proportion at the time when the time on stream was 23.5 hours was 40.85%. There was almost no difference between each of the two samples and the feed oil.

EXAMPLE 3

In Example 3, an experiment was conducted using the light hydrocarbon oil shown below as a feed oil. In the hydrogenation reaction, the same hydrogenation reaction catalyst and the same reaction conditions as in Example 1 were used. In the isomerization, an isomerization catalyst which was the same as in Example 1 was used, except that it was not a regenerated catalyst but a freshly prepared catalyst which had undergone the pretreatment. The following isomerization conditions were used.

1) Feed oil

Feed oil name: light naphtha II

ASTM distillation characteristics:

| | |
|---|---|
| IBP | 28.0° C. |
| 10% | 35.0° C. |
| 50% | 48.0° C. |
| 90% | 75.5° C. |
| 95% | 83.0° C. |
| EP | 90.5° C. |

Organosulfur content: 428 mass ppm

Content of i-$C_5$: 16.84 mass %

Content of n-$C_5$: 20.38 mass %

Content of 22DMC$_3$: 0.05 mass %

Others: 62.73 mass %

Isomer proportion: 45.32%

2) Hydrogenation Reaction Conditions

Reaction temperature: 230° C.

Reaction pressure: 30 kg/cm$^2$g

LHSV: 2.9

$H_2$/oil ratio: 370 liter/liter

Content of organosulfur: 3 mass ppm

3) Isomerization Conditions

Reaction temperature: 196° C.

Reaction pressure: 30 kg/cm$^2$g

LHSV: 2.9

$H_2$/oil ratio: 370 liter/liter

Figure 3:
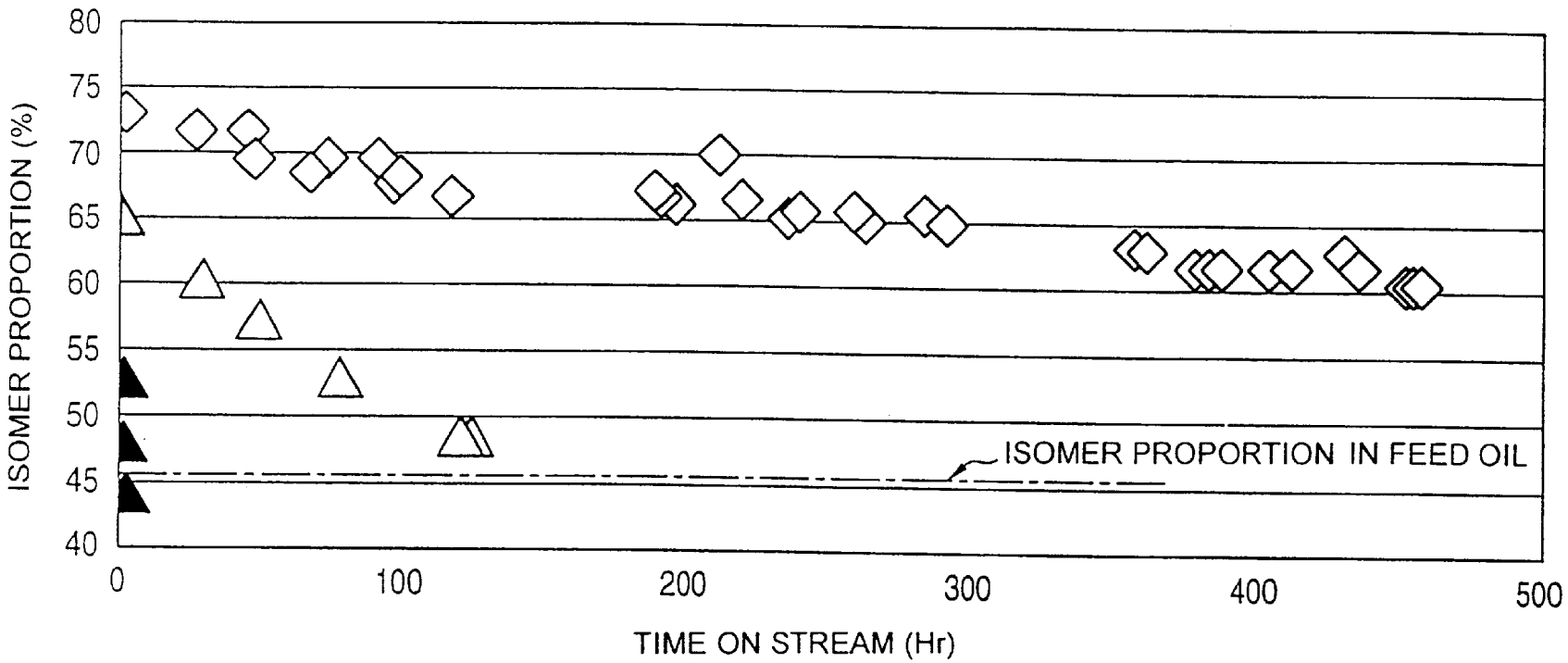
FIG. 3 is a graph showing the relationship between the isomer proportion in the isomerized light hydrocarbon oil and the time on stream in each of Example 3 (◇) and Comparative Examples 3 (▲) and 4 (Δ).

The isomer proportion was determined at intervals in the time on stream in the same manner as in Example 1, and the results are shown in FIG. 3 and Table 4. Table 3 shows the isomerization conditions used in each of Example 3, Comparative Examples 3 and 4. In Example 3, the isomer proportion at the time when the time on stream was 461 hours was 60.5%, and the difference between the sample and the feed oil was 15.2%.

Table 5 shows the mass % of each of 22DMC$_3$, i-$C_5$, and n-$C_5$ in the isomerized light hydrocarbon oil as determined at intervals in the each time on stream of Example 3, Comparative Examples 3 and 4.

TABLE 3

| | Ex. 3 | Comp. Ex. 3 | Comp. Ex. 4 |
|---|---|---|---|
| Reaction temperature (° C.) | 196 | 183 | 222 |
| Reaction pressure (kg/cm$^2$g) | 30 | ← | ← |
| LHSV | 2.9 | ← | ← |
| $H_2$/OIL (liter/liter) | 370 | ← | ← |

TABLE 4

| Reaction time | Isomer proportion in isomerized light hydrocarbon oil (%) | | |
|---|---|---|---|
| (h) | Ex. 3 | Comp. Ex. 3 | Comp. Ex. 4 |
| 3.0 | | 53.4 | |
| 4.0 | | 47.9 | |
| 4.5 | 73.6 | | |
| 5.0 | | 44.0 | |
| 7.0 | | | 65.7 |
| 30.5 | 71.5 | | |
| 32.5 | | | 60.6 |
| 45.0 | 71.2 | | |
| 50.0 | 69.9 | | |
| 51.0 | | | 58.0 |
| 70.0 | 69.2 | | |
| 74.0 | 69.6 | | |
| 79.5 | | | 53.0 |
| 94.0 | 69.4 | | |
| 98.5 | 68.3 | | |
| 102.0 | 68.3 | | |
| 118.0 | 66.7 | | |
| 121.0 | | | 49.0 |
| 125.0 | | | 49.0 |
| 190.0 | 67.0 | | |
| 194.5 | 66.5 | | |
| 197.5 | 66.1 | | |
| 214.0 | 69.7 | | |
| 221.0 | 66.3 | | |
| 238.0 | 65.4 | | |
| 242.5 | 65.9 | | |
| 262.0 | 65.4 | | |
| 265.0 | 64.9 | | |
| 286.0 | 65.4 | | |
| 293.0 | 64.8 | | |
| 360.0 | 63.7 | | |
| 362.0 | 63.9 | | |
| 365.5 | 63.5 | | |
| 382.5 | 61.8 | | |
| 386.0 | 62.1 | | |
| 390.0 | 62.4 | | |
| 406.0 | 62.2 | | |
| 413.5 | 61.7 | | |
| 431.9 | 62.6 | | |
| 437.7 | 61.7 | | |
| 454.0 | 60.6 | | |
| 458.0 | 60.6 | | |
| 461.0 | 60.5 | | |

TABLE 5

| Reaction time | Ex. 3 | | | Comp. Ex. 3 | | | Comp. Ex. 4 | | |
|---|---|---|---|---|---|---|---|---|---|
| (h) | $22DMC_3$ | $i\text{-}C_5$ | $n\text{-}C_5$ | $22DMC_3$ | $i\text{-}C_5$ | $n\text{-}C_5$ | $22DMC_3$ | $i\text{-}C_5$ | $n\text{-}C_5$ |
| 3.0 | | | | 0.039 | 23.750 | 20.760 | | | |
| 4.0 | | | | 0.038 | 21.240 | 23.150 | | | |
| 4.5 | 0.050 | 32.860 | 11.790 | | | | | | |
| 5.0 | | | | 0.036 | 19.330 | 24.660 | | | |
| 7.0 | | | | | | | 0.043 | 29.380 | 15.350 |
| 30.5 | 0.039 | 31.490 | 12.580 | | | | | | |
| 32.5 | 0.040 | 31.800 | 12.900 | | | | 0.040 | 27.110 | 17.660 |
| 45.0 | | | | | | | | | |
| 50.0 | 0.030 | 29.550 | 12.740 | | | | | | |
| 51.0 | | | | | | | 0.035 | 25.310 | 18.300 |
| 70.0 | 0.040 | 30.960 | 13.770 | | | | | | |
| 74.0 | 0.030 | 30.420 | 13.300 | | | | | | |
| 79.5 | | | | | | | 0.035 | 23.450 | 20.760 |
| 94.0 | 0.039 | 31.270 | 13.780 | | | | | | |
| 98.5 | 0.033 | 29.460 | 13.670 | | | | | | |
| 102.0 | 0.033 | 29.260 | 13.590 | | | | | | |
| 118.0 | 0.035 | 29.280 | 14.620 | | | | | | |
| 121.0 | | | | | | | 0.033 | 21.260 | 22.130 |
| 125.0 | | | | | | | 0.032 | 21.220 | 22.150 |
| 190.0 | 0.031 | 28.080 | 13.860 | | | | | | |
| 194.5 | 0.035 | 29.100 | 14.680 | | | | | | |
| 197.5 | 0.034 | 28.750 | 14.790 | | | | | | |
| 214.0 | 0.036 | 32.940 | 14.350 | | | | | | |
| 221.0 | 0.033 | 28.830 | 14.650 | | | | | | |
| 238.0 | 0.038 | 28.990 | 15.380 | | | | | | |
| 242.5 | 0.041 | 29.480 | 15.280 | | | | | | |
| 262.0 | 0.036 | 28.740 | 15.240 | | | | | | |
| 265.0 | 0.031 | 27.660 | 14.960 | | | | | | |
| 286.0 | 0.036 | 29.090 | 15.430 | | | | | | |
| 293.0 | 0.033 | 27.670 | 15.060 | | | | | | |
| 360.0 | | | | | | | | | |
| 362.0 | 0.034 | 27.700 | 15.690 | | | | | | |
| 365.5 | 0.033 | 27.280 | 15.720 | | | | | | |
| 382.5 | | | | | | | | | |
| 386.0 | 0.033 | 26.430 | 16.120 | | | | | | |
| 390.0 | 0.034 | 27.050 | 16.300 | | | | | | |
| 406.0 | 0.037 | 27.640 | 16.810 | | | | | | |
| 413.5 | 0.031 | 26.030 | 16.180 | | | | | | |
| 431.9 | 0.038 | 27.630 | 16.540 | | | | | | |
| 437.7 | 0.037 | 27.180 | 16.930 | | | | | | |
| 454.0 | 0.036 | 26.640 | 17.350 | | | | | | |
| 458.0 | | | | | | | | | |
| 461.0 | 0.035 | 26.470 | 17.300 | | | | | | |

Comparative Examples 3 and 4

In Comparative Examples 3 and 4, isomerization was conducted using the same feed oil as in Example 3 in the same manner as in Example 3, except that the hydrogenation reaction treatment was omitted and that the isomerization was conducted at temperatures of 183° C. and 222° C. The isomer proportions were determined at intervals in the time on stream in the same manner as in Example 1, and the results are shown in FIG. 3 and Table 4.

In Comparative Examples 3 and 4, the respective isomer proportions became almost the same as that in the feed oil at the times when the time on stream had reached 5 hours and 125 hours, respectively. The progress of the isomerization was hence judged to have stopped due to a decrease in catalytic activity.

EXAMPLE 4

Figure 4:
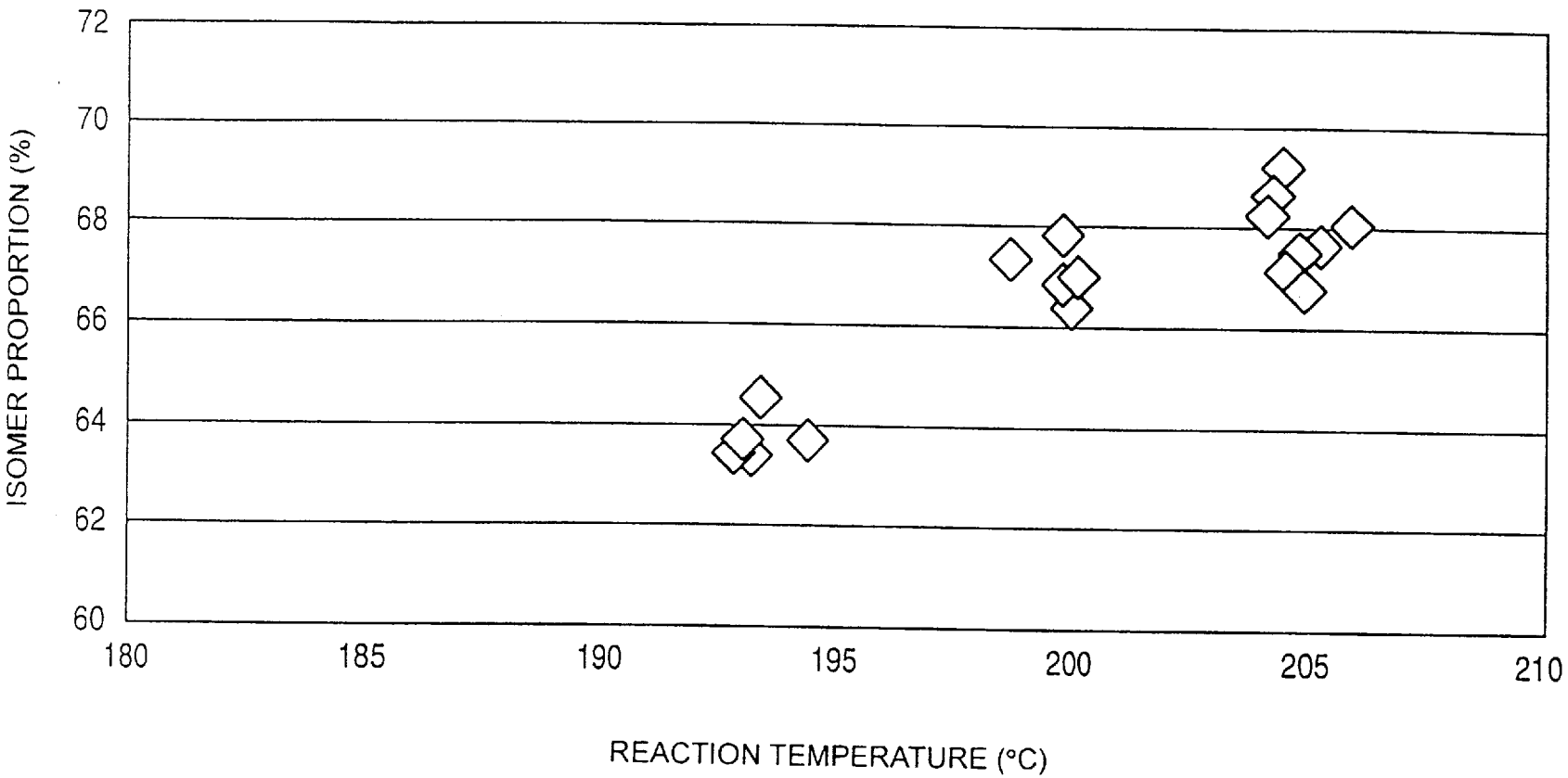
FIG. 4 is a graph showing the relationship between the isomer proportion in the isomerized light hydrocarbon oil and the reaction temperature in Example 4.
Figure 5:
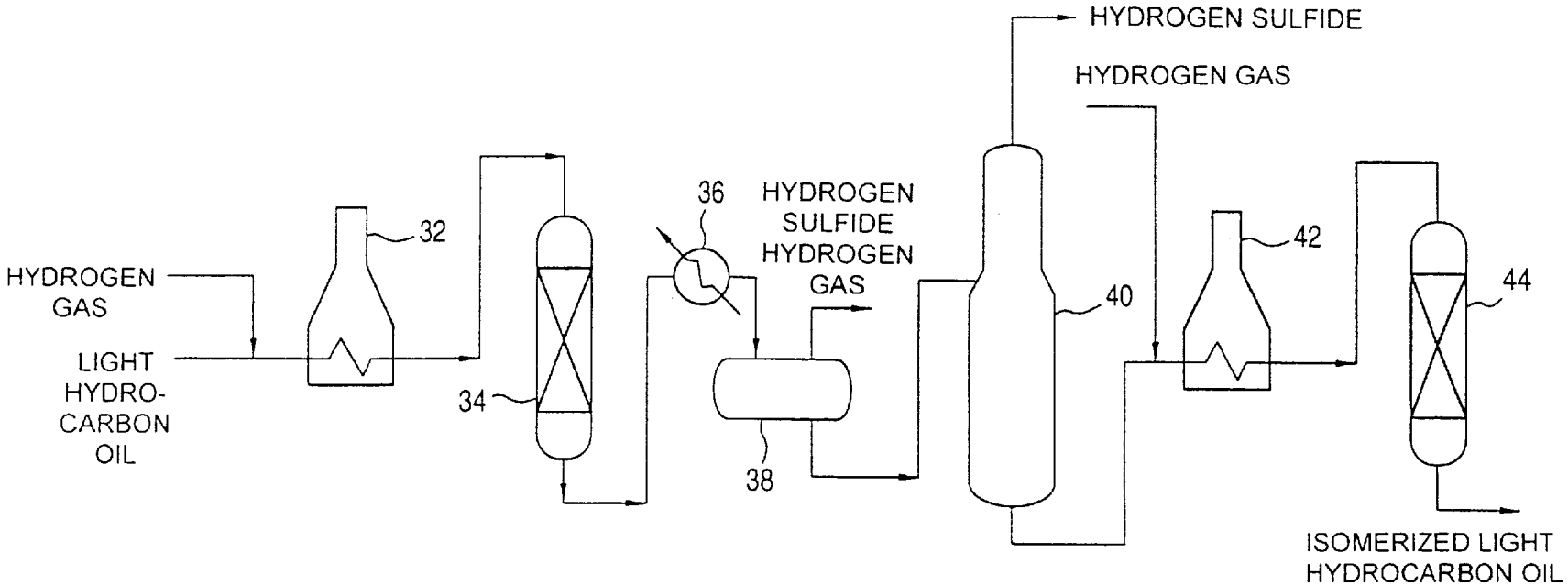
FIG. 5 is a diagrammatic flow sheet illustrating the constitution of an isomerization apparatus for use in doing a conventional isomerization process.

In Example 4, the isomer proportion was determined during the period wherein the time on stream was from 5 to 10 hours, under the same conditions as in Example 1, except that only the isomerization reaction temperature was varied. The results shown in FIG. 4 and Table 6 were obtained.

TABLE 6

| Reaction temperature (° C.) | Isomer proportion (%) |
|---|---|
| 199.9 | 67.9 |
| 198.8 | 67.5 |
| 200.0 | 66.8 |
| 200.2 | 67.2 |
| 200.1 | 66.4 |
| 200.3 | 67.1 |
| 199.8 | 67.0 |
| 192.9 | 63.5 |
| 192.9 | 63.8 |
| 193.4 | 64.6 |
| 194.4 | 63.7 |
| 193.2 | 63.4 |
| 206.0 | 68.0 |
| 204.9 | 67.6 |
| 204.6 | 67.2 |
| 204.3 | 68.3 |
| 204.6 | 69.3 |
| 205.3 | 67.7 |
| 205.0 | 66.9 |
| 204.4 | 68.7 |

Comparative Example 5

The same feed oil as in Example 3 was pretreated in the same manner as in a conventional one to reduce the organosulfur content to 3 mass ppm. After the hydrogen sulfide was separated, isomerization was conducted under the same conditions as in Example 3 to measure the time on stream which was required for the isomer proportion to became 60%, which was the same as the final value in Example 3. As a result, that time on stream was 550 hours.

A comparison in the isomer proportion in an isomerized light hydrocarbon oil between Examples 1, 2, Comparative Examples 3 and 4 shows that the duration of catalytic activity for the solid super strong acid catalyst in Examples 1 and 2, wherein the organosulfur content is 30 mass ppm or less, is longer than in Comparative Examples 3 and 4. It could be further ascertained that since the decrease in catalytic activity is extremely gradual, the duration of catalytic activity is sufficiently long for practical use.

Moreover, a comparison between Example 3, Comparative Examples 3 and 4 shows that the duration of catalytic activity is prolonged by converting organosulfur contained in a feed naphtha into hydrogen sulfide.

It can be further seen from Example 4 that the degree of isomerization for the solid super strong acid catalyst is almost constant in the isomerization temperature range of from 200° C. to 206° C.

Furthermore, it can be ascertained from a comparison between Comparative Example 5 and Example 3 that the catalyst life of a solid super strong acid catalyst in the isomerization process according to the present invention is almost the same as the catalyst life of the solid super strong acid catalyst in the conventional isomerization process. It can hence be ascertained that even when a light hydrocarbon oil accompanied with hydrogen sulfide formed by conversion is used as a feed oil and isomerized without conducting the step of separating the hydrogen sulfide, according to the process of the present invention, the catalyst life of the solid super strong acid catalyst is not shortened.

Industrial Applicability

According to the process of the present invention, it is possible to greatly reduce the costs of hydrogen gas, thermal energy, and power while maintaining almost the same catalyst life as in conventional isomerization processes, by subjecting a light hydrocarbon oil to a hydrogenation pretreatment step to convert the organosulfur components contained therein into hydrogen sulfide and then isomerizing the light hydrocarbon oil still containing the hydrogen sulfide under specific conditions.

Furthermore, in the process of the present invention, the decomposition reaction of $C_7$ and heavier components can be inhibited and catalyst coking can be inhibited to improve the catalyst life.

What is claimed is:

1. A process for isomerizing a light hydrocarbon oil having an organosulfur content as determined by coulometric titration of from 100 to 1,000 mass ppm, which process comprises:

subjecting the light hydrocarbon oil to a hydrogenation treatment for converting an organosulfur component in the light hydrocarbon oil into hydrogen sulfide to give an organosulfur content of from 0 to 30 mass ppm as a pretreatment step; and isomerizing the light hydrocarbon oil still containing the converted hydrogen sulfide in the presence of a solid super strong acid catalyst under conditions at a temperature of from 190 to 300° C., a pressure of from 1 to 50 kg/cm$^2$g, an $H_2$/oil ratio of from 180 to 1800 liter/liter, and an LHSV of from 2 to 10 hr$^{-1}$ as an isomerization step, wherein said solid super strong acid catalyst is a solid catalyst which has deposited thereon a super strong acid having higher acidic properties than 100% sulfuric acid.

2. The process according to claim 1, wherein the isomerization is conducted at a temperature from 195 to 250° C.

3. The process according to claim 1, wherein the solid super strong acid catalyst is a catalyst obtained by incorporating at least one metal selected from a group consisting of the Groups VIII, VIIA, VIA, and IB in the periodic table and either a sulfate group or a precursor of a sulfate group into a support comprising a hydroxide or oxide of at least one metal selected from a group consisting of the Groups IV and III in the periodic table, followed by burning for stabilization.

4. The process according to claim 3, wherein the at least one metal selected from a group consisting of the Groups IV and III in the periodic table is selected from a group consisting of silicon, titanium, zirconium, tin, and aluminum.

5. The process according to claim 3, wherein the at least one metal selected from a group consisting of the Groups VIII, VIIA, VIA, and IB in the periodic table is selected from a group consisting of nickel, ruthenium, rhodium, palladium, platinum, iron, manganese, chromium, silver, and copper.

6. The process according to claim 3, wherein the at least one metal selected from a group consisting of the Groups VIII, VIIA, VIA, and IB in the periodic table is selected from a group consisting of nickel, ruthenium, rhodium, palladium, and platinum.

7. The process according to claim 3, wherein the at least one metal selected from a group consisting of the Groups IV and III in the periodic table is selected from a group consisting of silicon, titanium, zirconium, tin, and aluminum, and the at least one metal selected from a group consisting of the Groups VIII, VIIA, VIA, and IB in the periodic table is selected from a group consisting of nickel, ruthenium, rhodium, palladium, and platinum.

8. The process according to claim 3, wherein the at least one metal selected from a group consisting of the Groups IV and III in the periodic table is zirconium and the at least one metal selected from a group consisting of the Groups VIII, VIIA, VIA, and IB in the periodic table is platinum.

9. The process according to claim 3, wherein the at least one metal selected from a group consisting of the Groups VIII, VIIA, VIA, and IB in the periodic table is contained at an amount of from 0.01 to 10 parts by mass per 100 parts by mass of the support.

10. The process according to claim 3, wherein the burning for stabilization is conducted in an oxidizing atmosphere at a temperature from 450 to 800° C. for from 0.5 to 10 hours.

11. The process according to claim 1, wherein the light hydrocarbon oil has an ASTM distillation temperature of from 25 to 110° C.

12. The process according to claim 1, wherein the pretreatment step is conducted under conditions at a temperature of from 160 to 300° C., a pressure of from 1 to 50 kg/cm$^2$g, an $H_2$/oil ratio of from 180 to 1800 liter/liter, and an LHSV of from 2 to 10 hr$^{-1}$.

13. The process according to claim 1, wherein the solid super strong acid catalyst comprises a sulfate group.

14. The process according to claim 1, wherein said solid super strong acid catalyst has a Hammett acidity function $H_0$ not higher than that of 100% sulfuric acid which has an $H_0$ of −11.93.

* * * * *